US006752324B1

(12) United States Patent
Mattes

(10) Patent No.: US 6,752,324 B1
(45) Date of Patent: Jun. 22, 2004

(54) INJECTOR FOR A FUEL INJECTION SYSTEM FOR INTERNAL COMBUSTION ENGINES, WITH HYDRAULIC PRESTRESSING OF THE PRESSURE BOOSTER

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 164 days.

(21) Appl. No.: 09/869,162

(22) PCT Filed: Oct. 12, 2000

(86) PCT No.: PCT/DE00/03582

§ 371 (c)(1),
(2), (4) Date: Sep. 25, 2001

(87) PCT Pub. No.: WO01/31192

PCT Pub. Date: May 3, 2001

(30) Foreign Application Priority Data

Oct. 23, 1999 (DE) ..... 199 51 144

(51) Int. Cl.[7] ..... F02M 47/02
(52) U.S. Cl. ..... 239/88

(58) Field of Search ..... 239/86–96, 585.1–585.5, 239/533.2–533.12

(56) References Cited

U.S. PATENT DOCUMENTS

| | | | | |
|---|---|---|---|---|
| 3,464,627 A | | 9/1969 | Huber | |
| 4,858,439 A | | 8/1989 | Sawada et al. | |
| 4,899,935 A | * | 2/1990 | Yoshida et al. | 239/91 |
| 5,542,610 A | * | 8/1996 | Augustin | 239/533.8 |
| 5,641,121 A | * | 6/1997 | Beck et al. | 239/92 |
| 5,823,429 A | * | 10/1998 | Beck et al. | 239/5 |

FOREIGN PATENT DOCUMENTS

| | | |
|---|---|---|
| DE | 198 07 903 A | 9/1999 |
| EP | 0 826 876 A | 3/1998 |
| EP | 0 890 730 A | 1/1999 |

* cited by examiner

*Primary Examiner*—Gene Mancene
*Assistant Examiner*—Thach H Bui
(74) *Attorney, Agent, or Firm*—Ronald E. Greigg

(57) ABSTRACT

An injector, actuated by a piezoelectric actuator with a hydraulic booster, for a fuel injection system for internal combustion engines is disclosed, in which the pressure booster is always hydraulically prestressed.

21 Claims, 1 Drawing Sheet

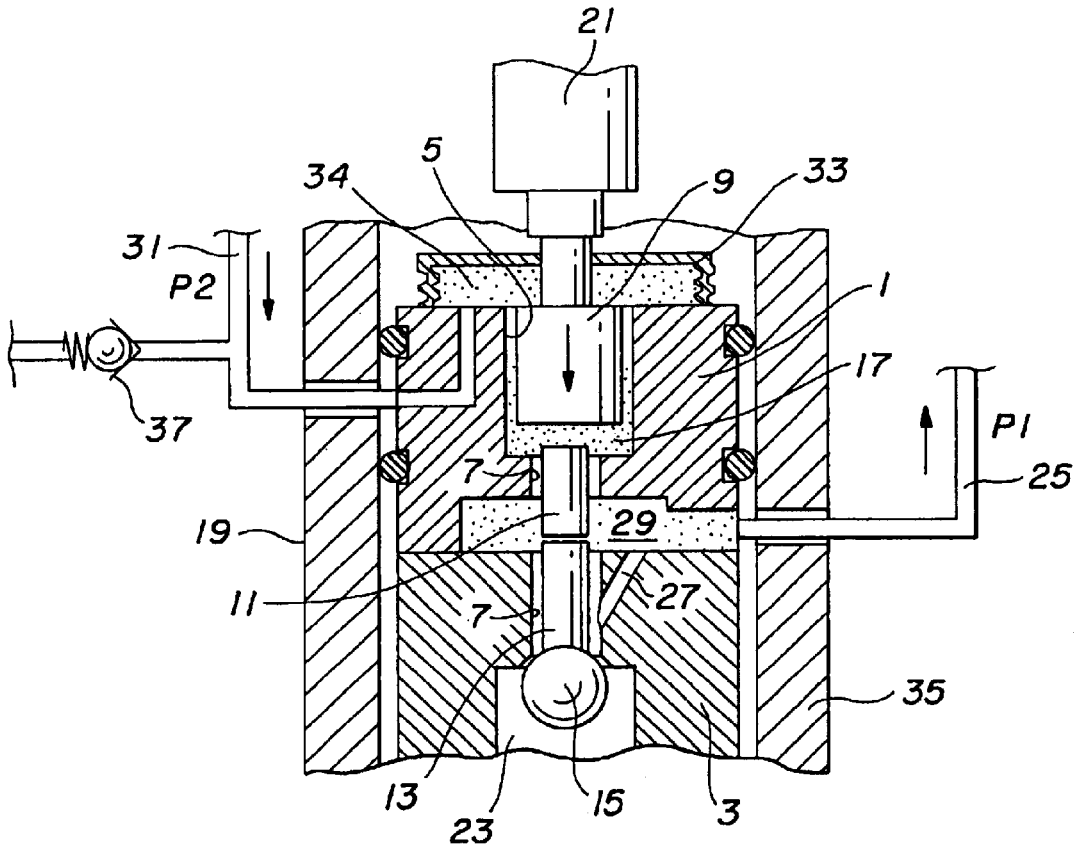
21
5
34
9
33
31
P2
1
17
37
P1
7
25
19
29
11
27
7
35
13
23
15
3

INJECTOR FOR A FUEL INJECTION SYSTEM FOR INTERNAL COMBUSTION ENGINES, WITH HYDRAULIC PRESTRESSING OF THE PRESSURE BOOSTER

CROSS-REFERENCE TO RELATED APPLICATIONS

This application is a 35 USC 371 application of PCT/DE 00/03582 filed on Oct. 12, 2000.

BACKGROUND OF THE INVENTION

1. Field of the Invention

The invention relates to an injector for a fuel injection system for internal combustion engines, having a pressure booster that has a first piston guided in a first guide bore and a second piston guided in a second guide bore, in which the first piston and the second piston define a pressure chamber that is under at least a supply pressure, and having a leaking oil line, the first piston being actuated by an actuator and the first piston at least indirectly actuating the final control element of a control valve, and to a fuel injection system for internal combustion engines using the injector.

2. Description of the Prior Art

To make it possible to assure a defined operating state of the injector and consequently good operating performance, and above all favorable engine starting performance, the second piston of the hydraulic pressure booster has until now been pressed against the final control element of the control valve by a spring, such as a cup spring.

This arrangement assures that the second piston of the hydraulic pressure booster will always assume a defined position, but air inclusions or the like can have the effect that a defined operating state of the injector is still lacking, and in particular that the engine starting performance is inadequate.

OBJECTS AND SUMMARY OF THE INVENTION

The primary object of the invention is to furnish an injector for a fuel injection system for internal combustion engines that has a pressure booster with improved operating performance.

This object is attained according to the invention by an injector for a fuel injection system for internal combustion engines, having a pressure booster that has a first piston guided in a first guide bore and a second piston guided in a second guide bore, wherein the first piston and the second piston define a pressure chamber that is under at least a supply pressure, and having a leaking oil line, wherein the first piston is actuated by an actuator and the first piston at least indirectly actuates the final control element of a control valve, in which the second guide bore communicates hydraulically with the leaking oil return and the pressure $p_1$ in the leaking oil return is lower than the supply pressure.

As a result of the prevailing pressure difference between the pressure chamber and the leaking oil return, a hydraulic force that presses the second piston against the final control element of the control valve always acts on the second piston.

As a result, not only is a defined position of the second piston of the hydraulic pressure booster assured, but in addition, there is a constant exchange of the fuel, or possible air inclusions, in the pressure booster.

Because of the low pressure level in the injector directly downstream of the control valve, the operating performance of the outlet throttle disposed between the control chamber and the control valve also improves.

In variants of the invention, the first guide bore, the first piston and the housing are sealed off from their surroundings, in particular by a bellows, so that no leakage can occur, and the supply pressure in the pressure chamber remains high.

Further in the invention, it is provided that supply pressure in the pressure chamber is furnished by a supply line discharging into the chamber formed by the housing, bellows and first piston, so that all the lines (31, 25, 27) and chambers (34, 17, 29) always have a flow of fuel through them.

In a further feature of the invention, a pressure holding valve is disposed in the supply line, so that pressure $p_2$ in the supply line is limited, in particular to 50 bar.

Another embodiment has a recess which is in communication with the leaking oil return at the second guide bore, so that the control and leakage quantities can be returned without problems.

In a further variant of the invention, the second piston actuates the final control element of the control valve via a tappet, so that the portions of the second guide bore that lead between the second piston and the tappet need not be precisely aligned, and different tolerances are possible.

Further in the invention, the outlet side of the control valve discharges into the leaking oil return, so that the control quantity is carried away.

In another feature of the invention, the actuator is a piezoelectric actuator, thus making major control forces available.

Another embodiment provides for mounting the housing, the control valve, and the actuator in a retaining body, thus on the one hand facilitating manufacture and mounting and on the other making a play-free, prestressed connection of the components possible.

The object stated above is also attained by a fuel injection system for internal combustion engines, having a high-pressure fuel pump, having a high pressure fuel reservoir, and having at least one injector according to the invention, so that the advantages of the invention come into play in this fuel injection system as well.

BRIEF DESCRIPTION OF THE DRAWING

Further objects and advantages of the invention can be learned from the ensuing description, taken in conjunction with the single figure of the drawing which is a sectional view schematically showing an injector embodying the invention.

DESCRIPTION OF THE PREFERRED EMBODIMENTS

In the drawing, one exemplary embodiment of an injector of the invention, with a hydraulic pressure booster, is shown. In a two-part housing 1 and 3, a first guide bore 5 and a second guide bore 7 are disposed coaxially to one another. A first piston 9 is guided in the first guide bore 5. The second guide bore 7 guides a second piston 11 and a tappet 13. Via the tappet 13, the second piston 11 acts on the spherical final control element 15 of the control valve, not shown, of the injector. Because of the two-piece design of the second piston 11 and tappet 13, the two portions of the second guide bore 7 need not be aligned precisely with one another;

furthermore, the play between the second piston 11 and the second guide bore 7 and between the tappet 13 and the second guide bore 7 can be selected to be different.

The first piston 9 and the second piston 11 define a pressure chamber 17 of a hydraulic pressure booster 19. A piezoelectric actuator 21 acts on the first piston 9. When the piezoelectric actuator 21 is actuated, it presses the first piston 9 in the direction of the arrow into the pressure chamber 17. As soon as the consequently rising pressure in the pressure chamber 17 suffices to exert a hydraulic force on the end face of the second piston 11 protruding into the pressure chamber 17 that is greater than the hydraulic force exerted by the fuel under control pressure in the control chamber 23 on the final control element 15, the final control element 15 opens and establishes a hydraulic communication between the control chamber 23 and a leaking oil return 25. This communication is effected via a portion of the second guide bore 7, a supply line 27 and a recess 29 of the second guide bore 7. As a result, the pressure in the control chamber 23 drops, and tie injection nozzle, not shown, opens.

As soon as the actuation of the piezoelectric actuator 21 ends, the piezoelectric actuator moves, together with the first piston 9, back into its outset position counter to the direction of the arrow. As a result, the pressure in the pressure chamber 17 drops. A supply line 31, in which a supply pressure $p_2$ prevails, supplies the pressure chamber 17 with fuel indirectly, via a bore in the housing 1 and a bellows 33.

The housing 1 and the first piston 9 are sealed off from their surroundings by the bellows 33. The supply line 31 discharges into the chamber 34 defined by the housing 1, first piston 9 and bellows 33 and fills this chamber with the fuel, which is at the pressure $p_2$. Through the annular gap between the first guide bore 5 and the first piston 9, fuel reaches the pressure chamber 17, so that this pressure chamber is always filled with fuel, and also, at least approximately, a pressure in the amount $p_2$ always prevails in the pressure chamber 17.

In the recess 29 as in the leaking oil return 25, a pressure $p_1$ prevails, which is lower than the supply pressure $p_2$. Consequently, a hydraulic force oriented from the piezoelectric actuator 21 to the final control element 15 acts on the second piston 11. As a consequence of this exertion of force, the second piston 11 and the final control tappet 13 are pressed against the final control elements 15, so that no play can arise between the second piston 11, tappet 13 and final control element 15. Instead, the pressure booster 19 is prestressed.

Since only the pressure pi prevails in the recess 29, fuel flows out of the pressure chamber 17 into the recess 29 through the annular gap between the second guide bore 7 and the second piston 11. Besides the aforementioned effect that the pressure difference between the pressure chamber 17 and the recess 29 connects the piston to the final control element 15 without play, the described flow of the fuel from the supply line 31 as far as the leaking oil return 25 has the effect that the entire pressure booster always experiences a flow of fresh, relatively cool fuel through it, thus lessening the risk of seizing; furthermore, any air or vapor bubbles that may be present are always conveyed out of the pressure booster 19 into the leaking oil return 25.

Another advantage of the embodiment according to the invention is that in contrast to the prior art, the bellows is always subjected to pressure only statically. As a result, an indication of the supply pressure $p_2$ without having to modify the bellows 33 is possible, and thus also an increase in the prestressing of the piezoelectric actuator. The supply pressure $p_2$ can for instance amount to 50 bar.

The entire injector, comprising the piezoelectric actuator 21, pressure booster 19 and the control valve, not shown, and the actual injection nozzle itself, are held together by a retaining body 35. The fuel flowing out of the supply line 31 through the retaining body 35 is prevented from flowing out into the surroundings by two O-rings, which are disposed between the retaining body 35 and the housing 1.

In the supply line 31, there is a pressure holding valve 37, which assures that an allowable maximum pressure in the supply line 31 and in the chambers 17 of the pressure booster that communicate hydraulically with the supply line 31 is never exceeded. As soon as this maximum pressure is reached, the pressure holding valve 37 opens. The outlet side of the pressure holding valve can be in communication with the leaking oil return 25, for instance.

The foregoing relates to preferred exemplary embodiment of the invention, it being understood that other variants and embodiments thereof are possible within the spirit and scope of the invention, the latter being defined by the appended claims.

I claim:

1. An injector for a fuel injection system for internal combustion engines, comprising a pressure booster (19) having a first piston (9) guided in a first guide bore (5) and a second piston (11) guided in a second guide bore (7), wherein the first piston (9) and the second piston (11) define a pressure chamber (17) that is under at least a supply pressure, and having a leaking oil return line (25), wherein the first piston (9) is actuated by an actuator (21) and the second piston (11) at least indirectly actuates the final control element (15) of a control valve, said second guide bore (7) communicates hydraulically with said leaking oil return (25), the pressure $p_1$ in the leaking oil return (25) being lower than the supply pressure.

2. The injector of claim 1, wherein the first guide bore (5), the first piston (9) and the housing (1, 3) are sealed off from their surroundings.

3. The injector of claim 2, further comprising a bellows (33) sealing off said first guide bore (5), said first piston (9) and said housing (1, 3) from their surroundings.

4. The injector of claim 2, wherein the supply pressure in the pressure chamber (17) is furnished by a supply line (31) discharging into the chamber (34) formed by the housing (1, 3), bellows (33) and first piston.

5. The injector of claim 1, further comprising a pressure holding valve (37) disposed in the supply line (31).

6. The injector of claim 5, wherein said pressure holding valve (37) limits the pressure $p_2$ in the supply line (31) to about 50 bar.

7. The injector of claim 1, further comprising a recess (29) which is in communication with the leaking oil return (25) is present at the second guide bore (7).

8. The injector of claim 1, wherein said second piston (11) actuates the final control element (15) of the control valve via a tappet (13).

9. The injector of claim 1, wherein the control valve discharges into the leaking oil return (25).

10. The injector of claim 1, wherein the actuator is a piezoelectric actuator (21).

11. The injector of claim 1, wherein the housing (1, 3), the control valve, and the actuator (21) are mounted in a retaining body (35).

12. A fuel injection system for internal combustion engines, including a high-pressure fuel pump, a high pressure fuel reservoir, and at least one injector said injector comprising a pressure booster (19) having a first piston (9) guided in a first guide bore (5) and a second piston (11) guided in a second guide bore (7), wherein the first piston (9) and the second piston (11) define a pressure chamber (17) that is under at least a supply pressure, and having a leaking oil return line (25), wherein the first piston (9) is actuated by an actuator (21) and the second piston (11) at least indirectly actuates the final control element (15) of a control valve, said second guide bore (7) communicates hydraulically with said leaking oil return (25), the pressure $p_1$ in the leaking oil return (25) being lower than the supply pressure.

13. The injector of claim 3, wherein the supply pressure in the pressure chamber (17) is furnished by a supply line (31) discharging into the chamber (34) formed by the housing (1, 3), bellows (33) and first piston.

14. The injector of claim 4, further comprising a pressure holding valve (37) disposed in the supply line (31).

15. The injector of claim 13, further comprising a pressure holding valve (37) disposed in the supply line (31).

16. The injector of claim 13, wherein said pressure holding valve (37) limits the pressure $p_2$ in the supply line (31) to about 50 bar.

17. The injector of claim 2, further comprising a recess (29) which is in communication with the leaking oil return (25) is present at the second guide bore (7).

18. The injector of claim 2, wherein said second piston (11) actuates the final control element (15) of the control valve via a tappet (13).

19. The injector of claim 2, wherein the control valve discharges into the leaking oil return (25).

20. The injector of claim 4, wherein the actuator is a piezoelectric actuator (21).

21. The injector of claim 4, wherein the housing (1, 3), the control valve, and the actuator (21) are mounted in a retaining body (35).

* * * * *